US008572763B2

(12) United States Patent
Fitzpatrick

(10) Patent No.: US 8,572,763 B2
(45) Date of Patent: Nov. 5, 2013

(54) REVERSIBLE GARMENT FOR PROVIDING HIGH-VISIBILITY WHEN RIDING A BICYCLE AND LOW PROFILE WHEN NOT RIDING A BICYCLE AND METHOD OF USING REVERSIBLE GARMENT

(75) Inventor: Michael J Fitzpatrick, Chicago, IL (US)

(73) Assignee: Brendan M. Fitzpatrick, Washington, DC (US)

( * ) Notice: Subject to any disclaimer, the term of this patent is extended or adjusted under 35 U.S.C. 154(b) by 1769 days.

(21) Appl. No.: 11/627,792

(22) Filed: Jan. 26, 2007

(65) Prior Publication Data

US 2007/0192925 A1 Aug. 23, 2007

Related U.S. Application Data

(60) Provisional application No. 60/763,193, filed on Jan. 28, 2006.

(51) Int. Cl.
*A41D 1/00* (2006.01)
*A41D 3/02* (2006.01)

(52) U.S. Cl.
USPC ..... 2/93; 2/85

(58) Field of Classification Search
USPC ..... 2/DIG. 2, 84, 85, 86, 93, 97
See application file for complete search history.

(56) References Cited

U.S. PATENT DOCUMENTS

| | | | | |
|---|---|---|---|---|
| 1,773,442 | A * | 8/1930 | Speh | 2/94 |
| 2,711,539 | A * | 6/1955 | Loscher | 2/93 |
| 4,328,533 | A * | 5/1982 | Paredes | 362/108 |
| 4,569,089 | A * | 2/1986 | Nesse | 2/108 |
| 6,345,393 | B1 * | 2/2002 | Bayer | 2/94 |
| 7,111,327 | B1 | 9/2006 | Blauer et al. | |
| 7,251,840 | B2 * | 8/2007 | Bayer | 2/227 |
| 2004/0163156 | A1 * | 8/2004 | Schweer | 2/69 |

* cited by examiner

*Primary Examiner* — Amber Anderson

(57) ABSTRACT

A reversible garment comprises first and second surfaces, each of which are capable of forming an outer surface of the garment when worn in reversible configurations. The first surface is generally ordinary in appearance while the second surface is highly visible. The reversible garment is preferably a bicycle jacket. The second surface may at least partially comprise a material that is reflective, bright in color, or luminescent. The second surface may be comprised of an elastic material to make the garment close-fitting in a high-visibility configuration.

12 Claims, 4 Drawing Sheets

10
A
12
14
16
18
20
22
24

10
12
14
16
18

80
82
84
86
88

80
94
96
98
100
102
103
111
112
113
114
115
116
118
120
C 80
82
84
88
94
104
105
108
109
111
112
114

REVERSIBLE GARMENT FOR PROVIDING HIGH-VISIBILITY WHEN RIDING A BICYCLE AND LOW PROFILE WHEN NOT RIDING A BICYCLE AND METHOD OF USING REVERSIBLE GARMENT

RELATED APPLICATION DATA

This application claims priority from, and incorporates by reference, provisional U.S. Patent Application No. 60/763,193, filed Jan. 28, 2006.

BACKGROUND OF THE INVENTION

Embodiments of the present invention generally relate to reversible garments, and more particularly, to reversible bicycle jackets that are reversible between ordinary and high-visibility configurations.

A growing number of the work force commutes to and from work by bicycle. The potential for an accident with an automobile involving injury and death is a constant risk for bicyclists. The risk cannot be eliminated, but bicyclists can do two things to help protect themselves. First, bicyclists can mitigate the severity of any such accidents by wearing protective gear such as bicycle helmets. Second, bicyclists can reduce the number of accidents by increasing their visibility to automobile drivers, using high-visibility gear such as lights, reflectors, and safety vests.

High-visibility gear such as lights and reflectors are typically attached to the bicycle itself. Safety vests are worn around the torso of the body as the outermost layer. Safety vests are high-visibility vests that are, for example, often worn by construction workers when working in the vicinity of traffic. Safety vests are available for purchase from numerous Internet vendors including The Traffic Safety Store at http://www.trafficsafetystore.com/safety-apparel.html. Additionally, high-visibility jackets are available for purchase from numerous Internet vendors including Logical, Inc. at http://www.safety-products.com. While it is important for bicyclists to use lights and/or reflectors when bicycling at night, it is important for bicyclists to wear safety vests or high-visibility jackets when bicycling regardless of the time of day.

Safety vests and high-visibility jackets are typically constructed of a material that complies with the American National Standard For High-Visibility Safety Apparel-ANSI (American National Standards Institute)/ISEA (International Safety Equipment Association) 107. The standard, commonly known as ANSI, sets forth three classes of ascending degree of high-visibility: ANSI Class I, ANSI Class II, and ANSI Class III. The higher the class, the more visible the material is.

Because safety vests and high-visibility jackets are so prominent and even flamboyant in appearance, they can be embarrassing to wear. Thus, there is a desire to remove them when not bicycling. When a bicycle commuter arrives at work, for example, he may remove the safety vest or high-visibility jacket prior to entering his office building to avoid unwanted attention. He may further put the safety vest or high-visibility jacket into a bag to place it out of sight (as opposed to carrying it).

Bicycle commuters may shower and change at health clubs or other facilities at or near their workplaces after bicycling to work and before arriving at their offices or other places of business. When bicycling to and from work, a bicycle commuter typically wears exercise clothes (and a safety vest or high-visibility jacket) and carries his work clothes (including a separate, ordinary jacket) in a bag such as a backpack. At the health club, the bicycle commuter showers, changes and bags his exercise clothes and the safety vest or high-visibility jacket. If the weather or personal tastes demand that a jacket be worn from the showering facilities to his office, the bicycle commuter may wear the ordinary (non high-visibility) jacket, which he carried in his bag during his bicycle commute.

Some bicycle commuters may take their morning shower at home and ride to work dressed in their work clothes. Such a commuter also wants to be highly visible while riding his bicycle and is likely to wear a safety vest or high-visibility jacket. After locking his bicycle near his office, if the weather or personal tastes demand that a jacket be worn from the place where he locks his bicycle to his office, the bicycle commuter may wear the ordinary (non high-visibility) jacket, which he carried in his bag during while riding his bicycle to work.

While bicyclists often want to be highly visible when riding their bicycles, they typically prefer to be inconspicuous or even fashionable when not riding their bicycles. Thus, it is not uncommon for a bicyclist to be wearing one jacket while carrying another. For example, when riding a bicycle, a bicyclist may wear a high-visibility jacket while carrying another, ordinary jacket. When the bicyclist dismounts his bicycle, he can switch the two jackets with one another (i.e., he can wear the ordinary jacket and carry the high-visibility jacket).

Having to remove a high-visibility jacket and place it in a bag out of sight upon completing a bicycle commute is inconvenient. Having to carry a separate, ordinary jacket in the bag while riding to work is also inconvenient. Thus, a need exists for a single bicycle jacket that can be used in both a high-visibility configuration and an ordinary configuration.

BRIEF SUMMARY OF THE INVENTION

Certain embodiments of the present invention provide a reversible garment that is reversible between a high-visibility configuration for riding a bicycle and an ordinary configuration for non-bicycle use. The garment is preferably a jacket (including a coat), but in other embodiments, the garment may be a pair of pants or a winter hat.

The reversible garment may be worn in the high-visibility configuration when the user is riding a bicycle and in the ordinary configuration when the user does not want to attract attention or wants to look fashionable. The garment is preferably reversible by simply turning the garment inside-out and outside-in.

In the high-visibility configuration, a high-visibility surface of the garment is exposed, making the garment highly visible. The high-visibility quality of the high-visibility surface may be due to reflective material, brightly colored material, and/or luminescent material. The high-visibility surface may include stripes, signs, symbols, and/or lights.

In the ordinary configuration, an ordinary surface of the garment is exposed, making the garment fashionable, or, at least, inconspicuous. If the garment is a jacket, it is configured to look like an ordinary jacket such as, for example, a fleece jacket, peacoat, ski jacket, leather jacket, windbreaker, or raincoat.

Certain embodiments of the present invention also provide methods for using a reversible garment that is reversible between a high-visibility configuration for riding a bicycle and an ordinary configuration for non-bicycle use.

Figure 1B:
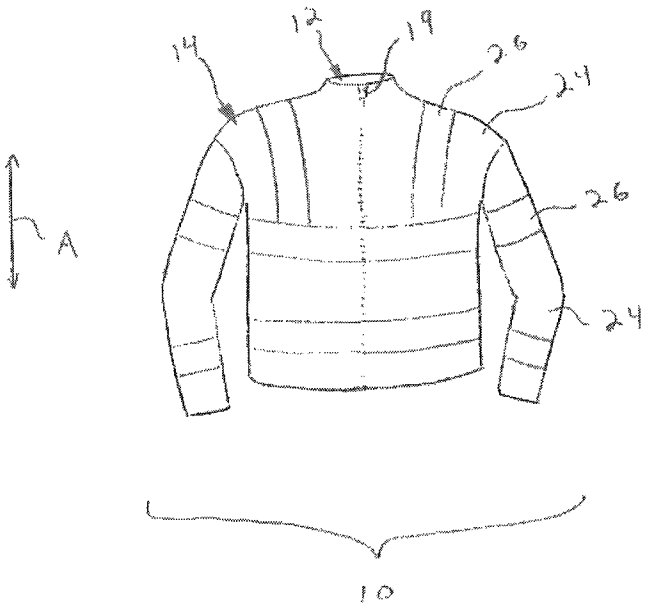
FIG. 1*b* illustrates a front perspective view of the reversible bicycle jacket in a second configuration according to an embodiment of the present invention.

The foregoing summary, as well as the following detailed description of certain embodiments of the present invention, will be better understood when read in conjunction with the appended drawings. For the purpose of illustrating the invention, there is shown in the drawings, certain embodiments. It should be understood, however, that the present invention is not limited to the arrangements and instrumentalities shown in the attached drawings.

DETAILED DESCRIPTION OF THE INVENTION

Figure 1A:
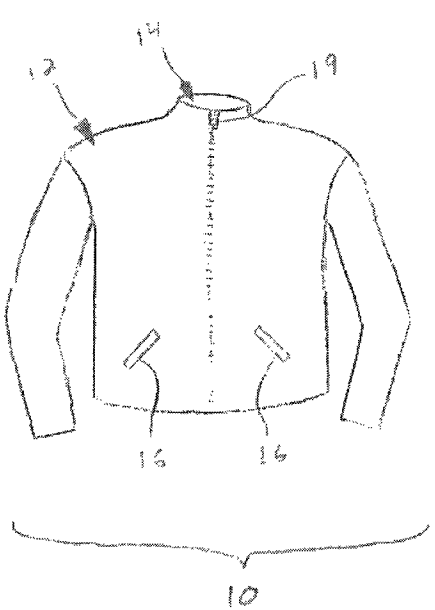
FIG. 1*a* illustrates a front perspective view of a reversible bicycle jacket in a first configuration according to an embodiment of the present invention.

FIG. 1 illustrates an embodiment of the present invention. Specifically, FIG. 1 illustrates a reversible bicycle jacket 10 that is reversible between ordinary and high-visibility configurations, as shown in FIGS. 1*a* and 1*b*, respectively. The bicycle jacket 10 includes an ordinary surface 12 and a high-visibility surface 14 opposite one another. The shell of the bicycle jacket 10 is formed by the joining of the opposing ordinary and high-visibility surfaces 12 and 14, respectively. The ordinary surface 12 and high-visibility surface 14 may contain insulation (not shown) therebetween. The bicycle jacket 10 is reversible between the ordinary configuration (FIG. 1*a*) and the high-visibility configuration (FIG. 1*b*) by simply pulling the bicycle jacket 10 inside-out and outside-in.

With reference to FIG. 1*a* (the ordinary configuration), the ordinary surface 12 is exposed as the outer surface of the bicycle jacket 10, and the high-visibility surface 14 is turned inward towards the bicyclist's body (not shown) when worn. The ordinary surface 12 is made of fleece. The ordinary surface 12 is constructed so that the bicycle jacket 10, when worn in the ordinary configuration (FIG. 1*a*), looks like a fleece jacket. Hence, when worn in the ordinary configuration (FIG. 1*a*), the bicycle jacket 10 give the bicyclist a low profile and/or appears fashionable.

For example, the bicycle jacket 10 may include fashionable pockets 16 that are accessible in the ordinary configuration (FIG. 1*a*) only. Additionally, a zipper 19 allows the bicycle jacket 10 to be closed or opened by pulling the zipper 19 up or down in the direction of arrow A. The zipper 19 is double-tabbed (not shown) and is accessible and useable in both configurations (FIGS. 1*a* and 1*b*).

With reference to FIG. 1*b* (the high-visibility configuration), the high-visibility surface 14 is exposed as the outer surface of the bicycle jacket 10, and the ordinary surface 12 is turned inward towards the bicyclist's body when worn. The high-visibility surface 14 is comprised of an ANSI-compliant fluorescent background 24. (ANSI refers to American National Standard For High-Visibility Safety Apparel-ANSI (American National Standards Institute)/ISEA (International Safety Equipment Association) 107. ANSI-compliant is defined as meeting the standards set forth in ANSI 107 Class 1, Class 2, or Class 3.) The high-visibility surface 14 also includes retro-reflective stripes 26 for added visibility. The retro-reflective stripes 26 may be comprised of 3M Scotchlite® retro-reflective strips or other suitable material. The fluorescent background 24 and retro-reflective stripes 26 make the bicycle jacket 10 (and the bicyclist) highly visible to others when worn in the high-visibility configuration of FIG. 1*b*.

The high-visibility surface 14 is of an elastic quality, which compresses the entire bicycle jacket 10 to form a close fit on the bicyclist when worn in the high-visibility configuration (FIG. 1*b*). Because the bicycle jacket 10 is close-fitting when worn in the high-visibility configuration (FIG. 1*b*), it offers the bicyclist reduced wind-resistance and increased comfort during bicycling.

The ordinary surface 12, unlike the high-visibility surface 14, is not elastic. Thus, when worn in the ordinary configuration (FIG. 1*a*), the bicycle jacket 10 appears to be loose-fitting.

With reference to FIGS. 1*a* and 1*b*, a bicyclist (not shown) can wear the reversible bicycle jacket 10 in the ordinary configuration (FIG. 1*a*) when not riding a bicycle. Because the ordinary surface 12 is exposed and the high-visibility surface 14 is concealed in the ordinary configuration (FIG. 1*a*), the bicyclist can maintain a low profile and/or appear fashionable. When the bicyclist wants to ride his bicycle, he can remove the bicycle jacket 10 from his body and convert it to the high-visibility configuration (FIG. 1*b*) by simply pulling the jacket 10 inside-out and outside-in. Because the high-visibility surface 14 is now exposed and the ordinary surface 12 is concealed, the bicyclist can maintain high-visibility to automobile traffic when he rides his bicycle. When the bicyclist finishes his bicycle ride, he can convert the jacket 10 back to the ordinary configuration (FIG. 1*a*) in order to achieve a low profile and/or appear fashionable.

Figure 2B:
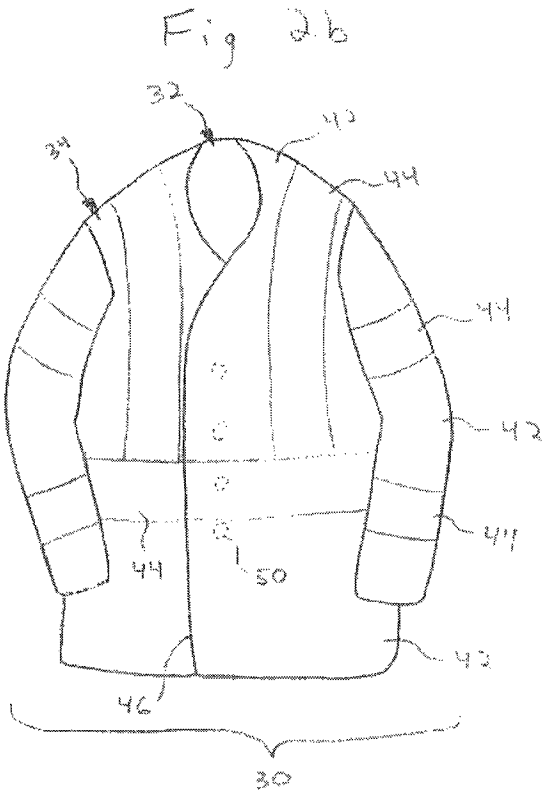
FIG. 2*b* illustrates a front perspective view of the reversible peacoat in a second configuration according to an embodiment of the present invention.
Figure 2A:
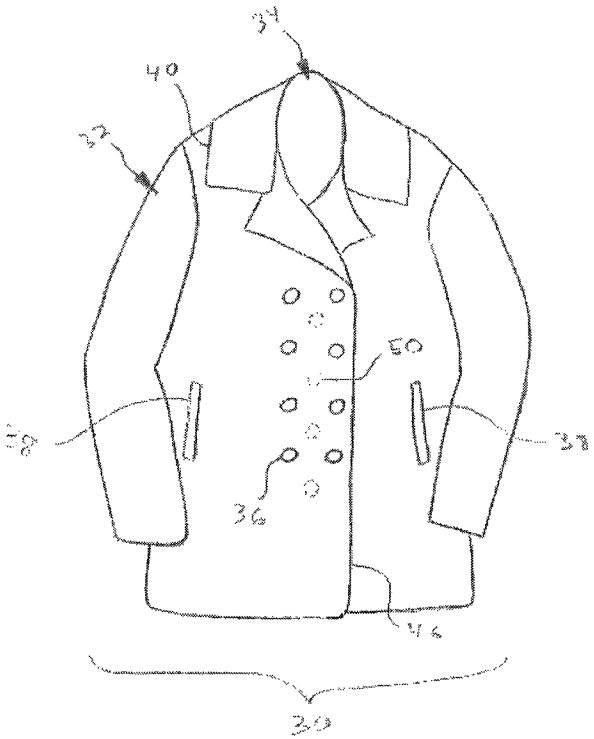
FIG. 2*a* illustrates a front perspective view of a reversible peacoat in a first configuration according to an embodiment of the present invention.

FIG. 2 illustrates another embodiment of the present invention. Specifically, FIG. 2 illustrates a reversible peacoat 30 that is reversible between ordinary and high-visibility configurations, as shown in FIGS. 2*a* and 2*b*, respectively. The reversible peacoat 30 includes an ordinary surface 32 and a high-visibility surface 34 opposite one another. The reversible peacoat 30 is reversible between the ordinary configuration (FIG. 2*a*) and the high-visibility configuration (FIG. 2*b*) by simply pulling the reversible peacoat 30 inside-out and outside-in.

With reference to FIG. 2*a* (the ordinary configuration), the ordinary surface 32 is exposed as the outer surface of the reversible peacoat 30, and the high-visibility surface 34 is turned inward towards the user's body (not shown) when worn. The ordinary surface 32 is made of wool. The ordinary surface 32 is constructed so that the reversible peacoat 30, when worn in the ordinary configuration (FIG. 2*a*), looks like a peacoat. Hence, when worn in the ordinary configuration (FIG. 2*a*), the reversible peacoat 30 gives the user a low profile and/or appears fashionable.

For example, the reversible peacoat 30 includes buttons 36 arranged in two vertical columns and attached to the front of the ordinary surface 32 for aesthetic purposes. Additionally, the reversible peacoat 30 includes pockets 38 that are accessible in the ordinary configuration (FIG. 2*a*) only. The reversible peacoat 30 also includes a collar 40 that is shown in the ordinary configuration (FIG. 2*a*) but not in the high-visibility configuration (FIG. 2*b*).

Although the exposed surface of the collar 40 is continuous with (e.g., it is simply folded over from) the high-visibility surface 34, the exposed surface of the collar 40 is not highly visible. Rather, the exposed surface of the collar 40 is made of wool and is of the same color and appearance as that of the ordinary surface 32. In the high-visibility configuration (FIG. 2*b*), the collar 40 is not visible because it is folded inward toward the user's body.

With reference to FIG. 2*b* (the high-visibility configuration), the high-visibility surface 34 is exposed as the outer surface of the reversible peacoat 30, and the ordinary surface 32 is turned inward towards the user's body when worn. The high-visibility surface 34 is comprised of an ANSI-compliant fluorescent background 42. The high-visibility surface 34 also includes retro-reflective stripes 44 for added visibility. The fluorescent background 42 and retro-reflective stripes 44 make the reversible peacoat 30 (and its user) highly visible to others when worn in the high-visibility configuration of FIG. 2*b*.

The reversible peacoat 30 includes two edges 46 that are pulled past one another when the reversible peacoat 30 is worn such that a portion of the high-visibility surface 34 overlaps and engages a portion of the ordinary surface 32 in the front of the peacoat 30. (Only one edge 46 is visible in each of FIG. 2*a* and FIG. 2*b*.) The reversible peacoat 30 is held closed in both configurations (FIGS. 2*a* and 2*b*) via snaps 50 (shown in broken lines) arranged in a vertical column along the front of the reversible peacoat 30 where the ordinary surface 32 and high-visibility surface 34 partially overlap. Specifically, the ordinary surface 32 includes a vertical column of female snap ends while the high-visibility surface 34 includes a complimentary vertical column of male snap ends. The male and female snap ends engage one another to form the snaps 50 and close the reversible peacoat 30 in either configuration (FIGS. 2*a* and 2*b*).

Figure 3B:
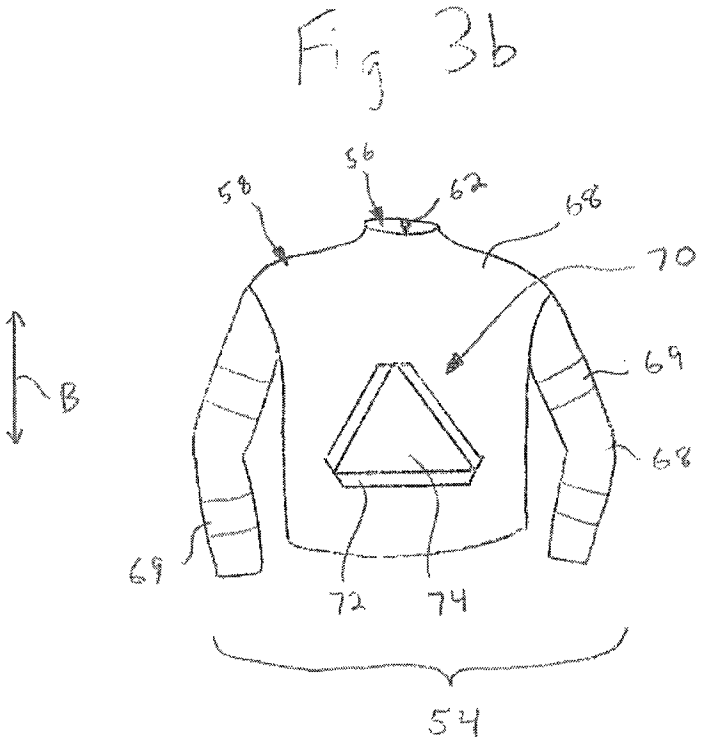
FIG. 3*b* illustrates a rear perspective view of the reversible bicycle jacket in a second configuration according to an embodiment of the present invention.
Figure 3A:
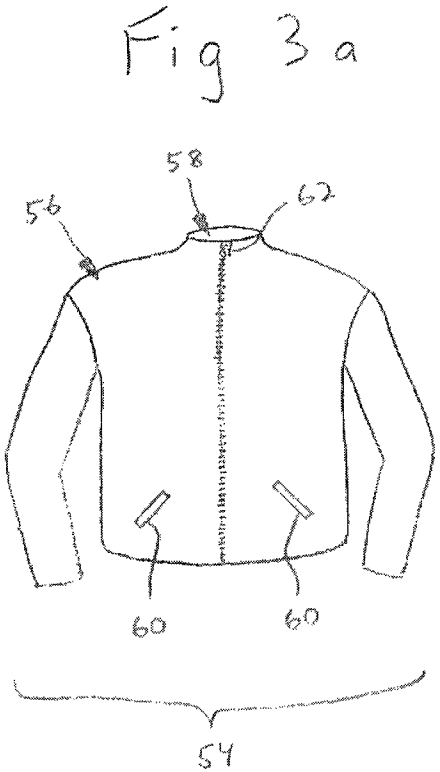
FIG. 3*a* illustrates a front perspective view of a reversible bicycle jacket in a first configuration according to an embodiment of the present invention.

FIG. 3 illustrates another embodiment of the present invention. Specifically, FIG. 3 illustrates a reversible bicycle jacket 54 that is reversible between an ordinary configuration (FIG. 3*a*) and a high-visibility configuration (FIG. 3*b*). FIG. 3*a* illustrates the bicycle jacket 54 in the ordinary configuration and from a front perspective. FIG. 3*b* illustrates the bicycle jacket 54 in the high-visibility configuration and from a rear perspective.

The bicycle jacket 54 includes an ordinary surface 56 and a high-visibility surface 58 opposite one another. The bicycle jacket 54 is reversible between the ordinary configuration (FIG. 3*a*) and the high-visibility configuration (FIG. 3*b*) by simply pulling the bicycle jacket 54 inside-out and outside-in.

With reference to FIG. 3*a* (the ordinary configuration), the ordinary surface 56 is exposed as the outer surface of the bicycle jacket 54, and the high-visibility surface 58 is turned inward towards the user's body (not shown) when worn. The ordinary surface 56 is constructed from any material commonly used for jackets such as, for example, wool, fleece, polyester, nylon, leather, and cotton. The ordinary surface 56 is constructed so that the bicycle jacket 54, when worn in the ordinary configuration (FIG. 3*a*), looks like an ordinary jacket. Hence, when worn in the ordinary configuration (FIG. 3*a*), the bicycle jacket 54 gives the user a low profile and/or appears fashionable.

For example, the bicycle jacket 54 may include fashionable pockets 60 that are accessible in the ordinary configuration (FIG. 3*a*) only. Additionally, a zipper 62 allows the bicycle jacket 54 to be closed or opened by pulling the zipper 62 up or down in the direction of arrow B. The zipper 62 is accessible and useable in both configurations (FIGS. 3*a* and 3*b*).

With reference to FIG. 3*b* (the high-visibility configuration), the high-visibility surface 58 is exposed as the outer surface of the bicycle jacket 54, and the ordinary surface 56 is turned inward towards the user's body when worn. The high-visibility surface 58 is comprised of an ANSI-compliant fluorescent background 68. The high-visibility surface 58 includes retro-reflective stripes 69 extending around sleeves of the bicycle jacket 54. The high-visibility surface 58 also includes a "slow moving vehicle" sign 70 that is generally triangular in shape and centrally located on the back of the bicycle jacket 54. The "slow moving vehicle" sign 70 includes three border strips 72 forming a triangular perimeter. The border strips 72 are preferably retro-reflective and bright red in color. An equilateral triangle 74 is formed by, and located within, the three border strips 72. The equilateral triangle 74 is preferably retro-reflective and bright orange in color. The fluorescent background 68 and "slow moving vehicle" sign 70 make the bicycle jacket 54 (and its user) highly visible to others when worn in the high-visibility configuration of FIG. 3*b*. The "slow-moving vehicle" sign 70 also signifies that the user is moving at a slower velocity than automobile traffic.

Figures 4A, 4B, 4C:
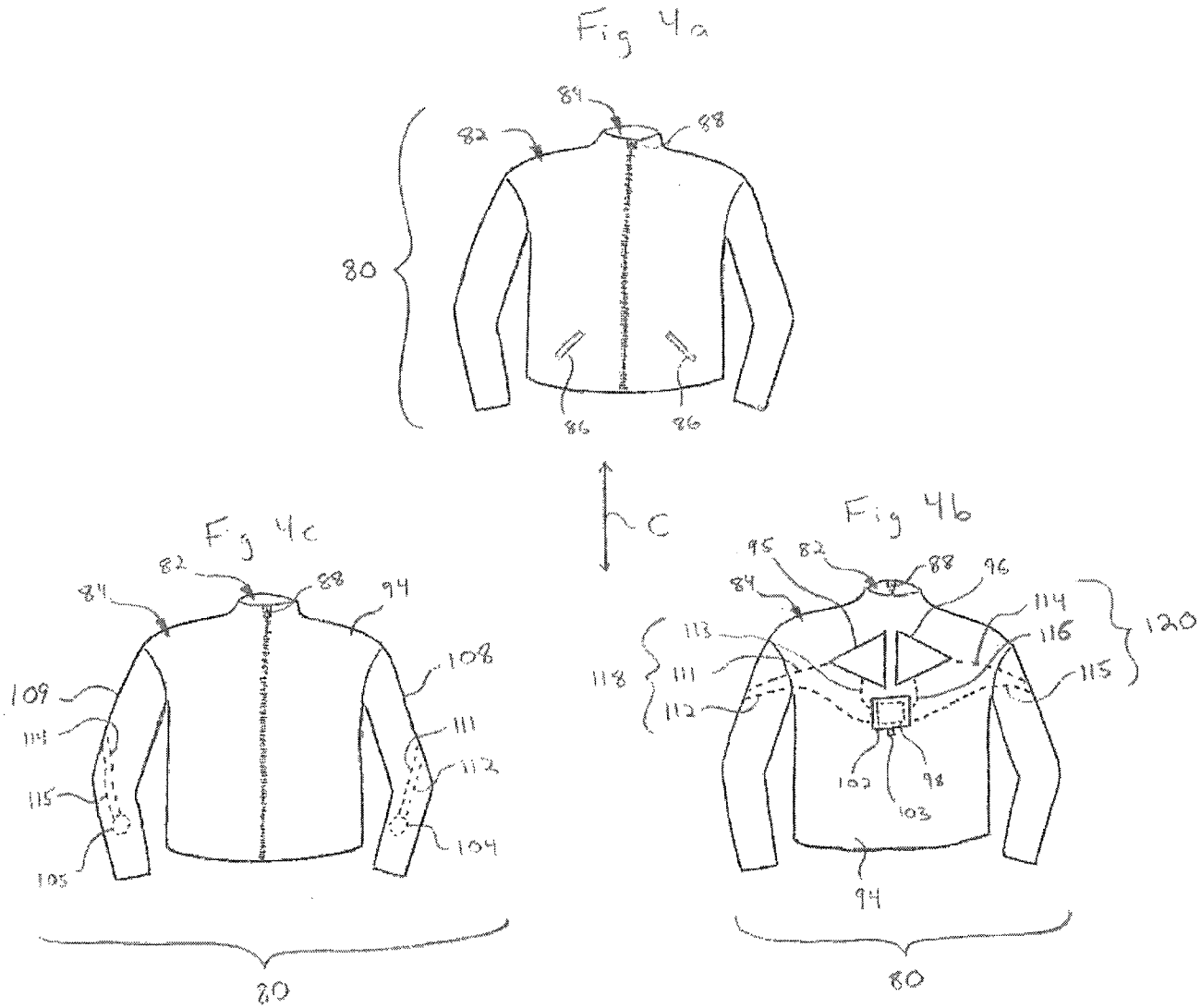
FIG. 4*a* illustrates a front perspective view of a reversible bicycle jacket in a first configuration according to an embodiment of the present invention.
FIG. 4*b* illustrates a rear perspective view of the reversible bicycle jacket in a second configuration according to an embodiment of the present invention.
FIG. 4*c* illustrates a front perspective view of the reversible bicycle jacket in the second configuration according to an embodiment of the present invention.

FIG. 4 illustrates another embodiment of the present invention. Specifically, FIG. 4 illustrates a reversible bicycle jacket 80 that is reversible between an ordinary configuration (FIG. 4*a*) and a high-visibility configuration (FIGS. 4*b* and 4*c*). FIG. 4*a* illustrates the bicycle jacket 80 in the ordinary configuration and from a front perspective. FIG. 4*b* illustrates the bicycle jacket 80 in the high-visibility configuration and from a rear perspective. FIG. 4*c* illustrates the bicycle jacket 80 in the high-visibility configuration and from a front perspective.

The bicycle jacket 80 includes an ordinary surface 82 and a high-visibility surface 84 opposite one another. The bicycle jacket 80 is reversible between the ordinary configuration (FIG. 4*a*) and the high-visibility configuration (FIGS. 4*b* and 4*c*) by simply pulling the bicycle jacket 80 inside-out and outside-in.

With reference to FIG. 4*a* (the ordinary configuration), the ordinary surface 82 is exposed as the outer surface of the bicycle jacket 80, and the high-visibility surface 84 is turned inward towards the user's body (not shown) when worn. The ordinary surface 82 is constructed from any material commonly used for jackets such as, for example, wool, fleece, polyester, nylon, leather, and cotton. The ordinary surface 82 is constructed so that the bicycle jacket 80, when worn in the ordinary configuration (FIG. 4*a*), looks like an ordinary jacket. Hence, when worn in the ordinary configuration (FIG. 4*a*), the bicycle jacket 80 gives the user a low profile and/or appears fashionable.

For example, the bicycle jacket 80 may include fashionable pockets 86 that are accessible in the ordinary configuration (FIG. 4*a*) only. Additionally, a zipper 88 allows the bicycle jacket 80 to be closed or opened by pulling the zipper 88 up or down in the direction of arrow C. The zipper 88 is accessible and useable in both configurations (see FIGS. 4*a* and 4*c*).

With reference to FIG. 4*b* (the high-visibility configuration, rear perspective), the high-visibility surface 84 is exposed as the outer surface of the bicycle jacket 80, and the ordinary surface 82 is turned inward towards the user's body when worn. The high-visibility surface 84 is comprised of a high-visibility background 94. The high-visibility surface 84 also includes left and right electrically-powered indicator lights 95 and 96, respectively, on the back of the bicycle jacket 80. The left and right indicator lights 95-96 are arrowhead-shaped and point to the left and right, respectively.

The bicycle jacket 80 includes a battery compartment 98 (shown in broken lines) for housing a battery (not shown) that provides electricity to the left and right indicator lights 95-96. The battery compartment 98 is located between the opposing ordinary and high-visibility surfaces, 82 and 84, respectively, which form the shell of the bicycle jacket 80. More specifically, the battery compartment 98 is located within the shell and below the left and right indicator lights 95-96. The battery compartment 98 can be accessed in the high-visibility configuration (FIG. 4*b*) through a hinged flap 102 located on the high-visibility surface 84, which, like the battery compartment 98, is located beneath the left and right indicator lights 95-96. The hinged flap includes a tab 103 for grasping and lifting the hinged flap 102 to access the battery compartment 98. When not opened to access the battery compartment 98, the hinged flap 102 may be secured to the high-visibility surface 84 via Velcro® or other fastening means (not shown).

With reference to FIG. 4*c* (the high-visibility configuration, front perspective), the bicycle jacket 80 includes left and right button switches 104-105 in left and right sleeves 108-109 of the bicycle jacket 80, respectively. The left and right switches 104 and 105 respectively control the left and right indicator lights 95 and 96. The switches 104-105 are located within the shell (i.e., between the opposing ordinary and high-visibility surfaces, 82 and 84, respectively) of the bicycle jacket 80 at approximately the midpoints of the forearms of a user (not shown) when wearing the bicycle jacket 80.

The switches 104-105 are activated by a first depression, and deactivated by a second depression. Thus, a bicyclist can turn the left indicator light 95 on by depressing the left switch 104 against his left forearm using his right hand. After turning or moving left, the bicyclist can shut off the left indicator light 95 by depressing the left switch 104 a second time. The right indicator light 96 and right switch 105 work in the same manner using the left hand against the right forearm.

The bicycle jacket 80 includes six electrical wires 111-116 (shown in broken lines) running within the shell (i.e., between the opposing ordinary and high-visibility surfaces, 82 and 84, respectively). Three left wires 111-113 form a left electrical circuit 118, and three right wires 114-116 form a right electrical circuit 120. In the left electrical circuit 118, wire 111 connects the left indicator light 95 to the left switch 104, wire 112 connects the left switch 104 to the battery compartment 98, and wire 113 connects the battery compartment 98 to the left indicator light 95. In the right electrical circuit 120, wire 114 connects the right indicator light 96 to the right switch 105, wire 115 connects the right switch 105 to the battery compartment 98, and wire 116 connects the battery compartment 98 to the right indicator light 96.

While certain embodiments of the present invention employ reversible bicycle jackets having an ordinary configuration configured to look like a fleece jacket or peacoat, other embodiments may include reversible jackets having ordinary configurations configured to look like another type of jacket such as, for example, ski jackets, leather jackets, or windbreakers.

While certain embodiments of the present invention employ reversible bicycle jackets having ordinary surfaces comprised of fleece and wool, other embodiments may include ordinary surfaces comprised of leather, cotton, nylon, wind-resistant material, stain-resistant material, water-repellant material, or any other material (whether natural or synthetic) that is suitable for making jackets.

While certain embodiments of the present invention employ reversible bicycle jackets having high-visibility surfaces that comprise a fluorescent background overlaid by retro-reflective stripes, all high-visibility surfaces are contemplated. For example, further embodiments may include high-visibility surfaces that are partially or wholly comprised of reflective material (including retro-reflective), high-visibility surfaces that are partially or wholly bright in color, and high-visibility surfaces that are partially or wholly comprised of a luminescent material (including, for example, phosphorescent, electroluminescent, chemoluminescent, and incandescent). Also, further embodiments may include high-visibility surfaces that have non high-visibility backgrounds but have high-visibility stripes, symbols, or signs incorporated thereon or therein. Additionally, further embodiments may include high-visibility surfaces that have highly-visibility backgrounds but without any additional high-visibility stripes, symbols, or signs incorporated thereon or therein.

While certain embodiments of the present invention employ reversible bicycle jackets having high-visibility surfaces that comply with one of the three classifications set forth in ANSI 107, other embodiments may include high-visibility surfaces that do not necessarily fall within one of the three classifications set forth in ANSI 107.

While certain embodiments of the present invention employ a slow moving vehicle sign, other embodiments may include alternative signs or symbols.

While certain embodiments of the present invention employ indicator lights, other embodiments may include alternative vehicle lights such as, for example, taillights or blinking hazard lights.

While certain embodiments of the present invention employ lights on the back of a jacket, other embodiments may include lights positioned elsewhere on the jacket such as on the back of the sleeves.

While certain embodiments of the present invention employ button switches for controlling lights, the term "switch" includes any conventional mechanism for activating a light.

While certain embodiments of the present invention employ reversible bicycle jackets (including coats), other embodiments may include reversible pants, reversible thermal (i.e., winter) hats, reversible wetsuits, and reversible drysuits.

While certain embodiments of the present invention employ reversible bicycle jackets with a high-visibility surface for bicycling, other embodiments may include reversible jackets with a high-visibility surface for other activities or functions such as, for example, jogging, hiking, skiing, swimming, diving, and surfing.

While the invention has been described with reference to certain embodiments, it will be understood by those skilled in the art that various changes may be made and equivalents may be substituted without departing from the scope of the invention. In addition, many modifications may be made to adapt a particular situation or material to the teachings of the invention without departing from its scope. Therefore, it is intended that the invention not be limited to the particular embodiment disclosed, but that the invention will include all embodiments falling within the scope of the appended claims.

I claim:

1. A jacket, comprising a first surface that is ordinary in appearance and a said second surface that is highly visible, said jacket being a reversible bicycle jacket that is reversible between an ordinary configuration wherein said first surface is exposed as an outer surface of said jacket and a high-visibility configuration wherein said second surface is exposed as an outer surface of said jacket, at least a portion of said second surface being one of reflective and luminescent;

and wherein said first surface is configured to be loose fitting and said second surface is configured to be close-fitting.

2. The jacket of claim 1, wherein said jacket is reversible by pulling the inside-out and the outside-in.

3. The jacket of claim 1, wherein at least a portion of said second surface is reflective.

4. The jacket of claim 1, wherein at least part of said second surface is configured to be elastic.

5. The jacket of claim 1, wherein said second surface comprises one of a reflective stripe, a luminescent stripe, a reflective symbol, a luminescent symbol, a reflective sign, and a luminescent sign.

6. The jacket of claim 1, wherein said second surface comprises a vehicle light.

7. The jacket of claim 6, further comprising a switch for controlling said vehicle light.

8. The jacket of claim 1, wherein said first surface is substantially comprised of a natural material and said second surface is substantially comprised of a synthetic material.

9. The jacket of claim 1, wherein a substantial component of said first surface is one of wool, fleece, polyester, nylon, leather, and cotton.

10. The jacket of claim 1, wherein said second surface complies with the ANSI 107 Class 1 standard that was effective as of the filing date of the provisional patent application from which this patent application claims priority.

11. The jacket of claim 1, wherein said second surface complies with the ANSI 107 Class 2 standard that was effective as of the filing date of the provisional patent application from which this patent application claims priority.

12. The jacket of claim 1, wherein said second surface complies with the ANSI 107 Class 3 standard that was effective as of the filing date of the provisional patent application from which this patent application claims priority.

* * * * *